US007301519B2

(12) United States Patent
Kim

(10) Patent No.: US 7,301,519 B2
(45) Date of Patent: Nov. 27, 2007

(54) STN LCD DRIVER USING CIRCUIT WITH FEWER CAPACITORS AND METHOD THEREFOR

(75) Inventor: Hyung-seok Kim, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 347 days.

(21) Appl. No.: 10/649,557

(22) Filed: Aug. 26, 2003

(65) Prior Publication Data

US 2004/0066365 A1 Apr. 8, 2004

(30) Foreign Application Priority Data

Oct. 4, 2002 (KR) ..... 10-2002-0060672

(51) Int. Cl.
*G09G 3/36* (2006.01)

(52) U.S. Cl. ..... 345/96; 345/100

(58) Field of Classification Search ..... 345/87, 345/94–96, 98–100, 204, 208–213, 690
See application file for complete search history.

(56) References Cited

U.S. PATENT DOCUMENTS 5,859,632 A * 1/1999 Ito ..... 345/211
5,929,847 A * 7/1999 Yanagi et al. ..... 345/204
6,084,580 A * 7/2000 Takahashi et al. ..... 345/211
6,344,984 B1 * 2/2002 Miyazaki ..... 363/60
6,501,467 B2 * 12/2002 Miyazaki ..... 345/210
6,897,716 B2 * 5/2005 Miyazaki ..... 327/541
2002/0154080 A1 * 10/2002 Miyazaki ..... 345/87

FOREIGN PATENT DOCUMENTS

JP 2002-268610 9/2002

* cited by examiner

*Primary Examiner*—Jeff Piziali
(74) *Attorney, Agent, or Firm*—Mills & Onello LLP

(57) ABSTRACT

An STN LCD driver using a circuit with a reduced number of capacitors for driving voltage stabilization, and a method therefor, are provided. The STN LCD driver includes a driving voltage generating circuit, a common/segment driving circuit, first through third capacitors, and a control circuit. The driving voltage generating circuit generates first through fifth driving voltages to output the generated driving voltages via first through fifth output terminals. The common/segment driving circuit, which is controlled by a driving polarity signal, receives the first through fifth driving voltages and generates a common driving signal and a segment driving signal. The first capacitor is connected between the first output terminal and a ground voltage. The control circuit controls connection of the output terminals and the capacitors in response to the driving polarity signal, in order to reduce the number of the capacitors for driving voltage stabilization.

19 Claims, 3 Drawing Sheets

STN LCD DRIVER USING CIRCUIT WITH FEWER CAPACITORS AND METHOD THEREFOR

This application claims the priority of Korean Patent Application No. 2002-60672 filed on Oct. 4, 2002, in the Korean Intellectual Property Office, the contents of which are incorporated herein in their entirety by reference.

BACKGROUND OF THE INVENTION

1. Field of the Invention

The present invention relates to the field of Super Twisted Nematic (STN) Liquid Crystal Display (LCD) technology, and more particularly, to an STN LCD driver using a circuit with fewer capacitors for driving voltage stabilization and improving display quality by stabilizing levels of driving voltages, and a method therefor.

2. Description of the Related Art

In a six-level driving method of an STN LCD driver, six driving voltages are used for driving a liquid crystal display. In detail, five driving voltages and a ground voltage are used. If the driving voltages have unstable levels, display quality may be degraded. Thus, to stabilize the levels of the driving voltages, the STN LCD driver uses capacitors, each of which is connected to a respective terminal where a voltage level is generated.

FIG. 1 is a schematic block diagram of a conventional STN LCD driver operated according to a six-level driving method. Referring to FIG. 1, the conventional STN LCD driver includes a driving voltage generating circuit 11 for generating five driving voltages, i.e., first through fifth driving voltages V0-V4, as well as a common/segment driving circuit 13 for generating a common driving signal COM and a segment driving signal SEG.

The driving voltage generating circuit 11 includes a voltage converter 111, a voltage regulator 112, and a voltage divider 113. The common/segment driving circuit 13 includes a common driver 131 and a segment driver 132.

In the conventional STN LCD driver, capacitors C0-C4 are connected to terminals from which driving voltages V0-V4 are generated, to stabilize the levels of driving voltages V0-V4.

However, as the capacitors C0-C4 for driving voltage stabilization occupy an increasingly large area, the entire chip area of the STN LCD driver increases. In addition, the capacitors C0-C4 for driving voltage stabilization fail to sufficiently stabilize levels of driving voltages for liquid crystal displays, thus degrading the display quality.

SUMMARY OF THE INVENTION

The present invention provides an STN LCD driver with a control circuit which has fewer capacitors for driving voltage stabilization and improves display quality by stabilizing levels of driving voltages.

The present invention also provides a method for reducing the number of capacitors for driving voltage stabilization used in an STN LCD driver and improving the display quality by stabilizing levels of driving voltages.

In accordance with an aspect of the present invention, there is provided an STN LCD driver comprising a driving voltage generating circuit, a common/segment driving circuit, first through third capacitors, and a control circuit. The driving voltage generating circuit generates first through fifth driving voltages and outputs the generated voltages via first through fifth output terminals. The common/segment driving circuit, controlled by a driving polarity signal, receives the first through fifth driving voltages and generates a common driving signal and a segment driving signal. The first capacitor is coupled between the first output terminal and a ground voltage. The control circuit controls connection of the output terminals and capacitors in response to the driving polarity signal.

It is preferred in the present invention that the control circuit include first through fourth switches. The first switch connects one end of the second capacitor to one of the first output terminal and fifth output terminal in response to the driving polarity signal. The second switch connects the other end of the second capacitor to one of the second output terminal and the ground voltage in response to the driving polarity signal. The third switch connects one end of the third capacitor to one of the second output terminal and the fourth output terminal in response to the driving polarity signal. The fourth switch connects the other end of the third capacitor to one of the third output terminal and fifth output terminal in response to the driving polarity signal.

In one embodiment, the common/segment driving circuit generates the common driving signal and the segment driving signal using the first driving voltage, fourth driving voltage, fifth driving voltage, and ground voltage, when the driving polarity signal is in a first logic state. The common/segment driving signal generates the common driving signal and the segment driving signal using the first driving voltage, second driving voltage, third driving voltage, and ground voltage, when the driving polarity signal is in a second logic state.

When the driving polarity signal is in the first logic state, one end of the second capacitor is coupled to the fifth output terminal by the first switch, the other end of the second capacitor is coupled to the ground voltage by the second switch, one end of the third capacitor is coupled to the fourth output terminal by the third switch, and the other end of the third capacitor is coupled to the fifth output terminal by the fourth switch.

When the driving polarity signal is in the second logic state, one end of the second capacitor is coupled to the first output terminal by the first switch, the other end of the second capacitor is coupled to the second output terminal by the second switch, one end of the third capacitor is coupled to the second output terminal by the third switch, and the other end of the third capacitor is coupled to the third output terminal by the fourth switch.

In accordance with another aspect of the present invention, there is provided a method for reducing the number of capacitors for driving voltage stabilization used in an LCD driver. The LCD driver includes a driving voltage generating circuit for generating first through fifth driving voltages and outputting the generated driving voltages via first through fifth output terminals, and a common/segment driving circuit, controlled by a driving polarity circuit, for receiving the first through fifth driving voltages to generate a common driving signal and a segment driving signal. The method comprises connecting a first capacitor between the first output terminal and a ground voltage. When the driving polarity signal is in a first logic state, one end of the second capacitor is coupled to the fifth output terminal by the first switch, the other end of the second capacitor is coupled to the ground voltage by the second switch, one end of the third capacitor is coupled to the fourth output terminal by the third switch, and the other end of the third capacitor is coupled to the fifth output terminal by the fourth switch. When the driving polarity signal is in a second logic state, one end of the second capacitor is coupled to the first output terminal by the first switch, the other end of the second capacitor is coupled to the second output terminal by the second switch, one end of the third capacitor is coupled to the second output terminal by the third switch, and the other end of the third capacitor is coupled to the third output terminal by the fourth switch.

The common/segment driving circuit generates a common driving signal and a segment driving signal using the first driving voltage, second driving voltage, third driving voltage, and ground voltage when the driving polarity signal is in the first logic state, and generates the common driving signal and the segment driving signal using the first driving voltage, fourth driving voltage, fifth driving voltage, and ground voltage when the driving polarity signal is in the second logic state.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
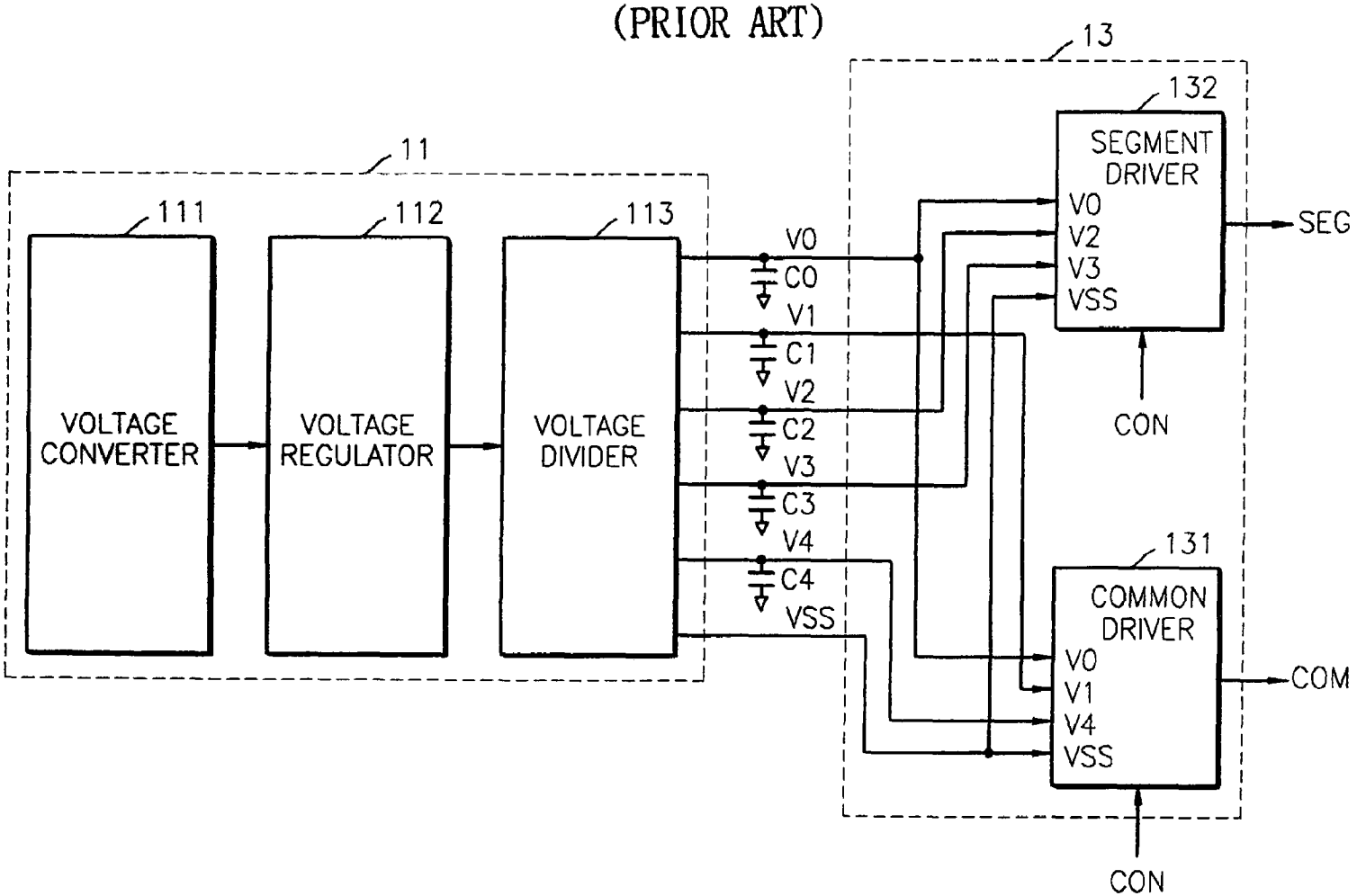
FIG. 1 (PRIOR ART)
FIG. 1 is a schematic block diagram of a conventional STN LCD driver operated according to a six-level driving method.
Figure 2:
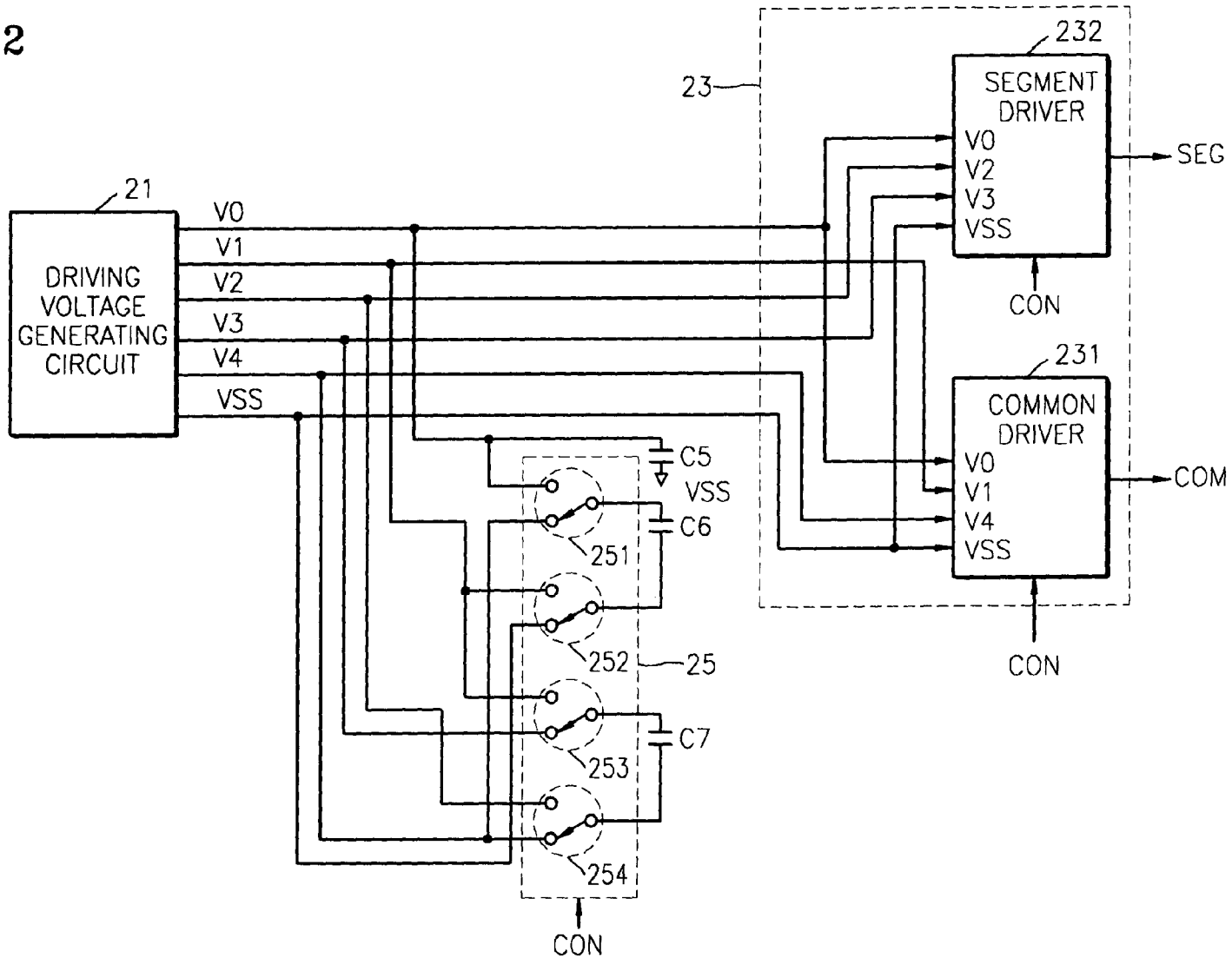
FIG. 2 is a schematic block diagram of an STN LCD driver according to an embodiment of the present invention, operated according to a six-level driving method.

FIG. 2 is a schematic block diagram of an STN LCD driver according to an embodiment of the present invention, operated according to a six-level driving method.

Referring to FIG. 2, the STN LCD driver of the present invention includes a driving voltage generating circuit 21 for generating first through fifth driving voltages V0-V4, and a common/segment driving circuit 23, controlled by a driving polarity signal CON, for receiving the first through fifth driving voltages V0-V4 to generate a common driving signal COM and a segment driving signal SEG.

In particular, the STN LCD driver includes a control circuit 25, with a reduced number of capacitors C5-C7 for stabilizing levels of the driving voltages V0-V4. The first capacitor C5 is connected between the output terminal from which the first driving voltage V0 is output and a ground voltage VSS, and the control circuit controls connection of the second capacitor C6 and the third capacitor C7 with the output terminals.

The voltage difference between every two adjacent driving voltages among the first through fifth driving voltages V0-V4 is the same. The common/segment driving circuit 23 includes a common driver 231 and a segment driver 232. The common driver 231, which is controlled by the driving polarity signal CON, receives the first driving voltage V0, the second driving voltage V1, the fifth driving voltage V4, and the ground voltage VSS and generates the common driving signal COM. The segment driver 232, which also is controlled by the driving polarity signal CON, receives the first driving voltage V0, the third driving voltage V2, the fourth driving voltage V3, and the ground voltage VSS and generates the segment driving voltage SEG.

The control circuit 25 includes first through fourth switches 251-254. The first switch 251 connects one end of the second capacitor C6 to the output terminal from which the first driving voltage V0 is output or the output terminal from which the fifth driving voltage V4 is output. The second switch 252 connects the other end of the second capacitor C6 to the output terminal from which the second driving voltage V1 is output or the ground voltage VSS in response to the driving polarity signal CON.

The third switch 253 connects one end of the third capacitor C7 to the output terminal from which the second driving voltage V1 is output or the output terminal from which the fourth driving voltage V3 is output in response to the driving polarity signal CON. The fourth switch 254 connects the other end of the third capacitor C7 to the output terminal from which the third driving voltage V2 is output or the output terminal from which the fifth driving voltage V4 is output.

Figure 3:
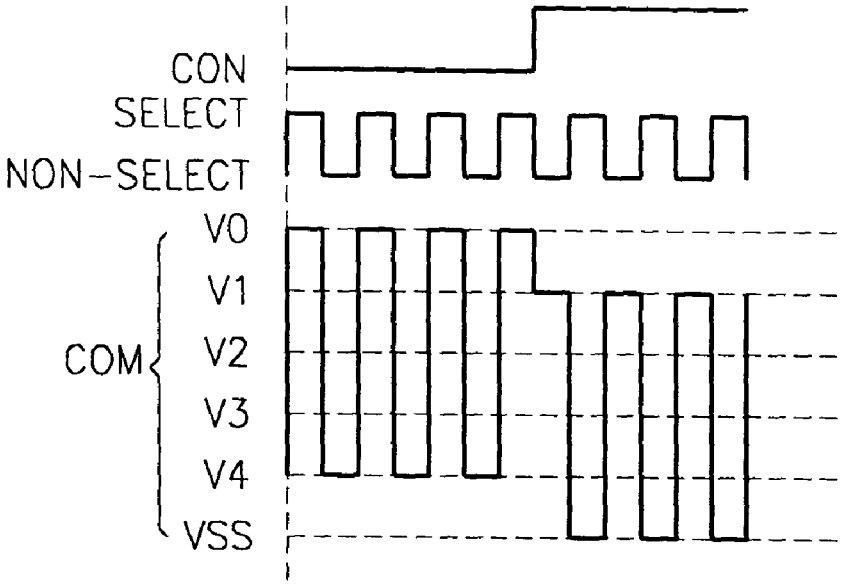
FIG. 3 illustrates a voltage waveform of a common driving signal COM based on a driving polarity signal CON of the STN LCD driver shown in FIG. 2, according to a six-level driving method.
Figure 4:
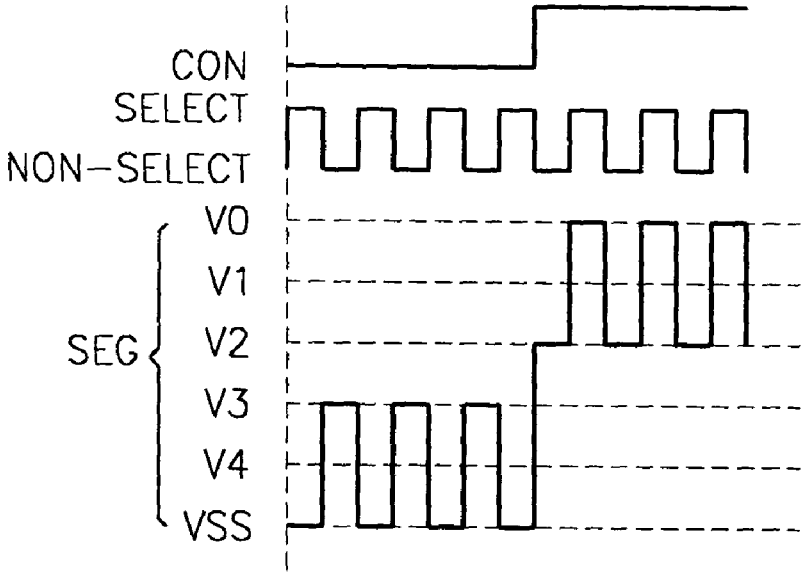
FIG. 4 illustrates a voltage waveform of a segment driving signal SEG based on a driving polarity signal COM of the STN LCD driver shown in FIG. 2, according to a six-level driving method.

FIG. 3 illustrates a voltage waveform of the common driving signal COM based on the driving polarity signal CON of the STN LCD driver according to the six-level driving method, and FIG. 4 illustrates a voltage waveform of the segment driving signal SEG based on the driving polarity signal CON of the STN LCD driver according to the six-level driving method.

Hereinafter, a method for reducing the number of capacitors for driving voltage stabilization in the STN LCD driver according to the present invention of FIG. 2 will be described in detail with reference to FIGS. 3 and 4. As illustrated in FIG. 3, when the driving polarity signal CON is in a first logic state, i.e., in a logic low state, the common driving signal COM has the first driving voltage level V0 and the fifth driving voltage level V4. When the driving polarity signal CON is in a second logic state, i.e., in a logic high state, the common driving signal COM has the second driving voltage level V1 and the ground voltage level VSS.

As illustrated in FIG. 4, when the driving polarity signal CON is in a logic low state, the segment driving signal SEG has the fourth driving voltage level V3 and the ground voltage level VSS. When the driving polarity signal CON is in a logic high state, the segment driving signal SEG has the first driving voltage level V0 and the third driving voltage level V2.

Thus, when the driving polarity signal CON is in the logic low state, the common driving signal COM and the segment driving signal SEG are generated using the first driving voltage V0, fourth driving voltage V3, fifth driving voltage V4, and ground voltage VSS. When the driving polarity signal CON is in the logic high state, the common driving signal COM and the segment driving signal SEG are generated using the first driving voltage V0, second driving voltage V1, third driving voltage V2, and ground voltage VSS.

Accordingly, in the present invention, the control circuit 25 can change connection of the capacitors C5-C7 for driving voltage stabilization according to the logic state of the driving polarity signal CON, thereby reducing the number of capacitors required for driving voltage stabilization.

For example, when the driving polarity signal CON is in the first logic state, i.e., in the logic low state, one end of the second capacitor C6 is coupled to the fifth driving voltage V4 by the first switch 251, the other end of the second capacitor C6 is coupled to the ground voltage VSS by the second switch 252, one end of the third capacitor C7 is coupled to the fourth driving voltage V3 by the third switch 253, and the other end of the third capacitor C7 is coupled to the fifth driving voltage V4 by the fourth switch 254.

Thus, when the driving polarity signal CON is in the logic low state, the third capacitor C7 and the second capacitor C6 are connected in series between the fourth driving voltage V3 and the ground voltage VSS, and the second capacitor C6 is connected between the fifth driving voltage V4 and the ground voltage VSS. Also, the third capacitor C7 is connected between the fourth driving voltage V3 and the fifth driving voltage V4. That is, when the driving polarity signal CON is in the logic low state, the capacitors for driving voltage stabilization are connected not to the driving voltages V1 and V2, but to the driving voltages V0, V3, and V4.

According to the foregoing method, unlike the conventional circuit using five capacitors for driving voltage stabilization, only three capacitors are used for driving voltage stabilization. Thus, the chip area occupied by the STN LCD driver can be decreased.

Furthermore, when an STN LCD driver is driven by the six-level driving method, the main factor affecting the display quality is a stabilization level of a relative voltage between two adjacent driving voltages V0-V1, V1-V2, V3-V4, or V4-VSS, rather than the stabilization level of each of the driving voltages V0, V1, V2, V3, and V4 individually. In the present invention, as described above, when the driving polarity signal CON is in the logic low state, i.e., when the driving voltages V0 V3, and V4 are used, the third capacitor C7 is connected between the fourth and fifth driving voltages V3 and V4 adjacent to each other. When the driving polarity signal CON is in the logic high state, i.e., when the driving voltages V0, V1, and V2 are used, the second capacitor C6 is connected between the first and second driving voltages V0 and V1 adjacent to each other, and the third capacitor C7 is connected between the second driving voltage V1 and the third driving voltage V2 adjacent to each other.

In the present invention, a capacitor is connected between two adjacent driving voltages, thereby stabilizing the relative voltage between the two driving voltages. Thus, the STN LCD driver of the present invention improves the display quality.

As set forth above, in the STN LCD driver of the present invention, the reduced number of capacitors for driving voltage stabilization enables the chip area to be scaled down. Also, since a capacitor is connected between two adjacent driving voltages, a relative voltage between the two driving voltages is stabilized, enhancing display quality.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display driver comprising:

a driving voltage generating circuit for generating first through fifth driving voltages and outputting the generated voltages via first through fifth output terminals;

a common/segment driving circuit, controlled by a driving polarity signal that is applied to the common/segment driving circuit, for receiving the first through fifth driving voltages to generate a common driving signal and a segment driving signal;

a first capacitor connected between the first output terminal and a ground voltage;

a second capacitor;

a third capacitor; and a control circuit comprising a plurality of switches for controlling connection of the output terminals and the capacitors in response to the driving polarity signal, wherein each switch of the plurality of switches is controlled by the driving polarity signal, and wherein the capacitors are selectively connected to driving voltages used by the common/segment driving circuit, but not to driving voltages not used by the common/segment driving circuit, according to a logic state of the driving polarity signal;

wherein the control circuit comprises:

a first switch for connecting one end of the second capacitor, in a first position of the first switch, to the first output terminal and connecting the one end of the second capacitor, in a second position of the first switch, to the fifth output terminal in response to the driving polarity signal;

a second switch for connecting the other end of the second capacitor, in a first position of the second switch, to the second output terminal and connecting the other end of the second capacitor, in a second position of the second switch, to the ground voltage in response to the driving polarity signal;

a third switch for connecting one end of the third capacitor, in a first position of the third switch, to the second output terminal and connecting the one end of the third capacitor, in a second position of the third switch, to the fourth output terminal in response to the driving polarity signal; and a fourth switch for connecting the other end of the third capacitor, in a first position of the fourth switch, to the third output terminal and connecting the other end of the third capacitor, in a second position of the fourth switch, to the fifth output terminal in response to the driving polarity signal.

2. The liquid crystal display driver as claimed in claim 1, wherein the common/segment driving circuit generates the common driving signal and the segment driving signal using the first driving voltage, the fourth driving voltage, the fifth driving voltage, and the ground voltage when the driving polarity signal is in a first logic state, and generates the common driving signal and the segment driving signal using the first driving voltage, the second driving voltage, the third driving voltage, and the ground voltage when the driving polarity signal is in a second logic state.

3. The liquid crystal display driver as claimed in claim 1, wherein when the driving polarity signal is in the first logic state, one end of the second capacitor is coupled to the fifth output terminal by the first switch, the other end of the second capacitor is coupled to the ground voltage by the second switch, one end of the third capacitor is coupled to the fourth output terminal by the third switch, and the other end of the third capacitor is coupled to the fifth output terminal by the fourth switch.

4. The liquid crystal display driver as claimed in claim 1, wherein when the driving polarity signal is in the second logic state, one end of the second capacitor is coupled to the first output terminal by the first switch, the other end of the second capacitor is coupled to the second output terminal by the second switch, one end of the third capacitor is coupled to the second output terminal by the third switch, and the other end of the third capacitor is coupled to the third output terminal by the fourth switch.

5. The liquid crystal display driver as claimed in claim 1, wherein the voltage difference between every two adjacent driving voltages among the first through fifth driving voltages is the same.

6. The liquid crystal display driver as claimed in claim 1, wherein the common/segment driving circuit comprises:

a common driving circuit, controlled by the driving polarity signal, for receiving the first driving voltage, the second driving voltage, the fifth driving voltage, and the ground voltage to generate the common driving signal; and a segment driving circuit, controlled by the driving polarity signal, for receiving the first driving voltage, the third driving voltage, the fourth driving voltage, and the ground voltage to generate the segment driving signal.

7. The liquid crystal display driver as claimed in claim 6, wherein the common driving signal has the first driving voltage level and the fifth driving voltage level when the driving polarity signal is in a first logic state, and has the second driving voltage level and the ground voltage level when the driving polarity signal is in a second logic state.

8. The liquid crystal display driver as claimed in claim 6, wherein the segment driving signal has the fourth driving voltage and the ground voltage when the driving polarity signal is in a first logic state, and has the first driving voltage and the third driving voltage when the driving polarity signal is in a second logic state.

9. A liquid crystal display driver comprising:

a driving voltage generating circuit for generating first through fifth driving voltages to output the generated driving voltages via first through fifth output terminals;

a common/segment driving circuit, controlled by a driving polarity signal that is applied to the common/segment driving circuit, for receiving the first through fifth driving voltages to generate a common driving signal and a segment driving signal;

a first capacitor connected between the first output terminal and a ground voltage;

a second capacitor;

a third capacitor;

a first switch for connecting one end of the second capacitor, in a first position of the first switch, to the first output terminal and connecting the one end of the second capacitor, in a second position of the first switch, to the fifth output terminal in response to the driving polarity signal;

a second switch for connecting the other end of the second capacitor, in a first position of the second switch, to the second output terminal and connecting the other end of the second capacitor, in a second position of the second switch, to the ground voltage in response to the driving polarity signal;

a third switch for connecting one end of the third capacitors, in a first position of the third switch, to the second output terminal and connecting the one end of the third capacitor, in a second position of the third switch, to the fourth output terminal in response to the driving polarity signal; and a fourth switch for connecting the other end of the third capacitor, in a first position of the fourth switch, to the third output terminal and connecting the other end of the third capacitor, in a second position of the fourth switch, to the fifth output terminal in response to the driving polarity signal, and wherein the capacitors are selectively connected to driving voltages used by the common/segment driving circuit, but not to driving voltages not used by the common/segment driving circuit, according to a logic state of the driving polarity signal.

10. The liquid crystal display driver as claimed in claim 9, wherein the common/segment driving circuit generates the common driving signal and the segment driving signal using the first driving voltage, the fourth driving voltage, the fifth driving voltage, and the ground voltage when the driving polarity signal is in a first logic state, and generates the common driving signal and the segment driving signal using the first driving voltage, the second driving voltage, the third driving voltage, and the ground voltage when the driving polarity signal is in a second logic state.

11. The liquid crystal display driver as claimed in claim 9, wherein when the driving polarity signal is in a first logic state, one end of the second capacitor is coupled to the fifth output terminal by the first switch, the other end of the second capacitor is coupled to the ground voltage by the second switch, one end of the third capacitor is coupled to the fourth output terminal by the third switch, and the other end of the third capacitor is coupled to the fifth output terminal by the fourth switch.

12. The liquid crystal display driver as claimed in claim 9, wherein when the driving polarity signal is in a second logic state, one end of the second capacitor is coupled to the first output terminal by the first switch, the other end of the second capacitor is coupled to the second output terminal by the second switch, one end of the third capacitor is coupled to the second output terminal by the third switch, and the other end of the third capacitor is coupled to the third output terminal by the fourth switch.

13. The liquid crystal display driver as claimed in claim 9, wherein the voltage difference between every two adjacent driving voltages among the first through fifth driving voltages is the same.

14. The liquid crystal display driver as claimed in claim 9, wherein the common/segment driving circuit comprises:

a common driving circuit, controlled by the driving polarity signal, for receiving the first driving voltage, the second driving voltage, the fifth driving voltage, and the ground voltage to generate the common driving signal; and a segment driving circuit, controlled by the driving polarity signal, for receiving the first driving voltage, the third driving voltage, the fourth driving voltage, and the ground voltage to generate the segment driving signal.

15. The liquid crystal display driver as claimed in claim 14, wherein the common driving signal has the first driving voltage level and the fifth driving voltage level when the driving polarity signal is in a first logic state, and has the second driving voltage level and the ground voltage level when the driving polarity signal is in a second logic state.

16. The liquid crystal display driver as claimed in claim 14, wherein the segment driving signal has the fourth driving voltage level and the ground voltage level when the driving polarity signal is in a first logic state, and has the first driving voltage level and the third driving voltage level when the driving polarity signal is in a second logic state.

17. A method for stabilizing driving voltage levels in a liquid crystal display driver including a driving voltage generating circuit for generating first through fifth driving voltages and outputting the generated voltages via first through fifth output terminals, and a common/segment driving circuit, controlled by a driving polarity signal that is applied to the common/segment driving circuit, for receiving the first through fifth driving voltages to generate a common driving signal and a segment driving signal, the method comprising:

connecting a first capacitor between the first output terminal and a ground voltage;

when the driving polarity signal is in a first logic state, connecting one end of a second capacitor to the fifth output terminal by a first switch in a first position of the first switch, connecting the other end of the second capacitor to the ground voltage by a second switch in a first position of the second switch, connecting one end of a third capacitor to the fourth output terminal by a third switch in a first position of the third switch, and connecting the other end of the third capacitor to the fifth output terminal by a fourth switch in a first position of the third switch; and when the driving polarity signal is in a second logic state, connecting one end of the second capacitor to the first output terminal by the first switch in a second position of the first switch, connecting the other end of the second capacitor to the second output terminal by the second switch in a second position of the second switch, connecting one end of the third capacitor to the second output terminal by the third switch in a second position of the third switch, and connecting the other end of the third capacitor to the third output terminal by the fourth switch in a second position of the fourth switch, and wherein the capacitors are selectively connected to driving voltages used by the common/segment driving circuit, but not to driving voltages not used by the common/segment driving circuit, according to a logic state of the driving polarity signal.

18. The method as claimed in claim 17, wherein the common/segment driving circuit generates the common driving signal and the segment driving signal using the first driving voltage, the second driving voltage, the third driving voltage, and the ground voltage when the driving polarity signal is in the first logic state, and generates the common driving signal and the segment driving signal using the first driving voltage, the fourth driving voltage, the fifth driving voltage, and the ground voltage when the driving polarity signal is in the second logic state.

19. The method as claimed in claim 17, wherein the voltage difference between every two adjacent driving voltages among the first through fifth driving voltages is the same.

* * * * *